US005595346A

United States Patent [19]

Haruch et al.

[11] Patent Number: 5,595,346

[45] **Date of Patent: *Jan. 21, 1997**

[54] AIR ASSISTED ATOMIZING SPRAY NOZZLE

[75] Inventors: James Haruch, Naperville; Tim Oberg, Glendale Heights, both of Ill.

[73] Assignee: Spraying Systems Co., Wheaton, Ill.

[ * ] Notice: The portion of the term of this patent subsequent to Apr. 20, 2012, has been disclaimed.

[21] Appl. No.: 349,402

[22] Filed: Dec. 2, 1994

Related U.S. Application Data

[63] Continuation-in-part of Ser. No. 119,889, Sep. 10, 1993, Pat. No. 5,385,304, which is a continuation of Ser. No. 871,833, Apr. 20, 1992, abandoned.

[51] Int. Cl.[6] ..... B05B 7/04

[52] U.S. Cl. ..... 239/431; 239/429; 239/434; 239/600

[58] Field of Search ..... 239/429–431, 239/433, 434, 600

[56] References Cited

U.S. PATENT DOCUMENTS

| | | | |
|---|---|---|---|
| 3,088,681 | 5/1963 | McCutcheon, Jr. | 239/431 |
| 3,558,063 | 1/1971 | Goff | 239/431 |
| 4,349,156 | 9/1982 | Haruch et al. | 239/432 |
| 4,625,916 | 12/1986 | Nieuwkamp et al. | 239/431 |
| 4,645,127 | 2/1987 | Emory et al. | 239/299 |
| 4,815,665 | 3/1989 | Haruch | 239/432 |
| 4,899,937 | 2/1990 | Haruch | 239/289 |
| 5,082,185 | 1/1992 | Evans | 239/416.5 |
| 5,190,224 | 3/1993 | Hamilton | 239/600 |
| 5,326,036 | 7/1994 | Wilger | 239/600 |
| 5,385,304 | 1/1995 | Haruch | 239/431 |
| 5,421,522 | 6/1995 | Bowen | 239/600 |

FOREIGN PATENT DOCUMENTS

| | | | |
|---|---|---|---|
| 450946 | 10/1991 | European Pat. Off. | 239/600 |
| 810733 | 3/1937 | France | 239/431 |
| 1303471 | 8/1962 | France | 239/431 |

OTHER PUBLICATIONS

Gold Crest® Actisol® Compact Unit Product Literature, Roussel Bio Corporation, Jacksonville, Florida 33224.

Gold Crest® Actisol® Commercial Unit Product Literature, Roussel Bio Corporation, Jacksonville, Florida 33224.

*Primary Examiner*—Lesley D. Morris

*Attorney, Agent, or Firm*—Leydig, Voit & Mayer, Ltd.

[57] ABSTRACT

An air assisted atomizing spray nozzle including an atomizing member having: (a) a mixing chamber, (b) a liquid inlet opening for injecting a liquid stream axially into the mixing chamber, (c) a pair of air inlet openings for injecting a pair of air streams radially into the mixing chamber in directions substantially opposed to one another and substantially perpendicular to the liquid stream for atomizing the liquid stream, and (d) an exit orifice in axial communication with the mixing chamber for discharging atomized liquid therefrom. The atomized liquid is sprayed into atmosphere by a spray tip. The atomizing member and the spray tip are held in assembled relation with a housing by a quick connect/quick release cap.

9 Claims, 4 Drawing Sheets

AIR ASSISTED ATOMIZING SPRAY NOZZLE

CROSS-REFERENCE TO RELATED APPLICATIONS

This application is a continuation-in-part of U.S. application Ser. No. 08/119,889, filed Sep. 10, 1993 now U.S. Pat. No. 5,385,304 which, in turn, is a continuation of U.S. application Ser. No. 07/871,833, filed Apr. 20, 1992 and now abandoned.

TECHNICAL FIELD

This invention is related generally to nozzles for spraying liquids, and more particularly, to improved air assisted atomizing spray nozzles.

BACKGROUND OF THE INVENTION

There are many different types of nozzles for spraying liquids. One type is a so-called air assisted atomizing spray nozzle. Such nozzles are capable of delivering a liquid in a finely divided, or atomized state. Atomization of a liquid in this type of nozzle is assisted by introducing air into the nozzle. More specifically, a liquid stream and an air stream are injected into a mixing chamber. The interaction of the air and liquid stream, among other factors, atomizes the liquid stream for discharge through an exit orifice of the nozzle.

Air assisted atomizing spray nozzles are used to apply agricultural chemicals and in other applications, such as pest control, where it is important to achieve a uniform distribution of relatively small amounts of chemicals. They also are used in humidifying systems to assure rapid evaporation of water into the atmosphere. Another use is in scrubbing systems for coal furnaces where rapid and complete chemical absorption of sulfurous gases must be optimized. In general, this type of nozzle is used in a wide variety of applications where it is important to deliver liquid in a finely atomized state.

One design for air assisted atomizing spray nozzles is shown in U.S. Pat. No. 5,082,185 to W. Evans. The nozzle shown therein is used with a hand-held spray gun which is particularly useful for applying pesticides. The air source for the gun can be either a high pressure tank or a tank which is pressurized by a hand pump. The design of the spray gun offers significant advantages, especially in that it reduces liquid leakage during shut-off. Nevertheless, the nozzle assembly shown in the above-mentioned Evans patent has room for improvement in several respects.

First, certain components of the nozzle are relatively fragile, in particular, the parts that define the mixing chamber 15 shown in FIG. 2 of the Evans patent. The spraying equipment with which the nozzle is used typically is carried from location to location. It also is carried by hand as pesticide is applied at a particular location. Under such circumstances, and even during assembly and repair of the nozzle, the perforated annular disk-shaped structure at the downstream end of the mixing chamber 15 may be bent or broken. Such damage, of course, can interrupt or diminish the performance of the spray nozzle.

Although durability may be less important if the nozzle is a component of a system which is more or less permanently installed, there are other problems with the design of the nozzle shown in the Evans patent. Nozzle parts very commonly are manufactured from cast or machined metal plugs, such as brass or stainless steel, which then are drilled or milled to provide the various openings and cavities. There are, however, a number of close-tolerance drillings which must be performed in order to form the mixing chamber 15 illustrated in the Evans patent. Consequently, manufacturing parts is relatively difficult and costly, and there are relatively high rejection rates during the manufacturing process.

In certain applications, a spray nozzle will be used to spray highly abrasive liquids, such as limestone slurries in a smoke stack scrubbing system. Under such conditions, the mixing chamber parts are subject to considerable wear. It is possible to increase the wear resistance of nozzle parts by using more wear resistant compositions, such as ceramics, but such materials must be cast or molded and cannot be readily machined. The mixing chamber part of the Evans patent, as a practical matter, cannot be adapted for use in high wear applications because the relatively complex design does not lend itself easily to casting or molding processes.

Moreover, it generally is desirable to minimize the quantity of air used to achieve a given degree of atomization of a given quantity of liquid. Improved air efficiency can permit the use of less expensive, lower capacity equipment and can lower operating costs in many systems. Air efficiency is especially important in equipment, such as that shown in the Evans patent, which relies on a portable air source. For example, the life span of high pressure tanks decreases as air consumption increases, and tanks have to be changed more frequently. If a hand pumped tank is used, work must be interrupted more frequently so that the tank can be pumped up.

The atomization process in this type of spray nozzle also is relatively inefficient because it relies on what may be called "parallel flow" of liquid and air. As can be seen best in the front elevational view of part 15 of the Evans patent, which view is shown in FIG. 2 and labeled 15*a*, the air streams and liquid streams are introduced into the mixing chamber parallel to each other. In other words, the liquid stream is introduced through the center aperture in part 15, and air is introduced through the four apertures radially disposed from the center hole but opening parallel to it.

One general approach to increasing the efficiency of the atomization process in mixing chambers has been to provide so-called impingement surfaces. Air assisted atomizing spray nozzles comprising impingement surfaces are shown, e.g., in U.S. Pat. No. 4,899,937 to J. Haruch, U.S. Pat. No. 4,815,665 to J. Haruch, and U.S. Pat. No. 4,349,156 to J. Haruch. In general, these types of designs inject a liquid stream and an air stream into a mixing chamber perpendicular to each other with an impingement surface being situated at or near the point where the streams intersect.

While this can create considerable turbulence, thereby improving the atomization process, the nozzle is more complex because it incorporates impingement surfaces. Generally, additional parts must be fabricated in order to provide an impingement surface. The relative alignment of the air inlet, liquid inlet, and impingement surface also must be relatively precisely controlled. As a consequence, it is more difficult and costly to manufacture nozzles of this type.

OBJECTS AND SUMMARY OF THE INVENTION

An object of this invention, therefore, is to provide an air assisted atomizing spray nozzle which is more durable in use and is less susceptible to bending or breaking.

A further object of the subject invention is to provide an air assisted atomizing spray nozzle which is more easily and reliably manufactured.

Another object of the subject invention is to provide an air assisted atomizing spray nozzle wherein most of the components of the nozzle may be made by an injection molding process.

Yet another object of the subject invention is to provide an air assisted atomizing spray nozzle which atomizes liquid more efficiently, thereby reducing the amount of air consumed.

It also is an object of the subject invention to provide an air assisted atomizing nozzle which may be quickly and easily assembled and disassembled and which may be converted for use with different types of spray tips and/or atomizers.

The foregoing objects and advantages of the invention will be apparent to those skilled in the art upon reading the following detailed description and upon reference to the drawings.

Figure 1:
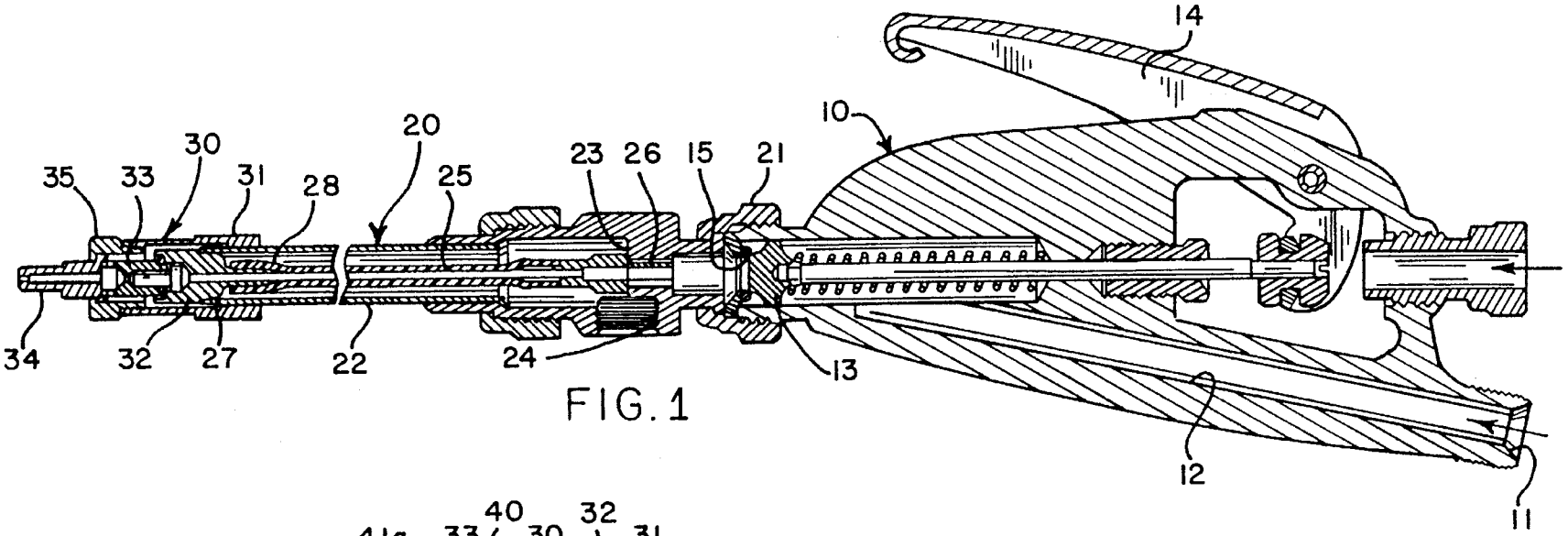
FIG. 1 is a longitudinal section of a hand held spray wand which incorporates a preferred embodiment of an air assisted atomizing spray nozzle of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DESCRIPTION OF THE PREFERRED EMBODIMENTS

Figure 2:
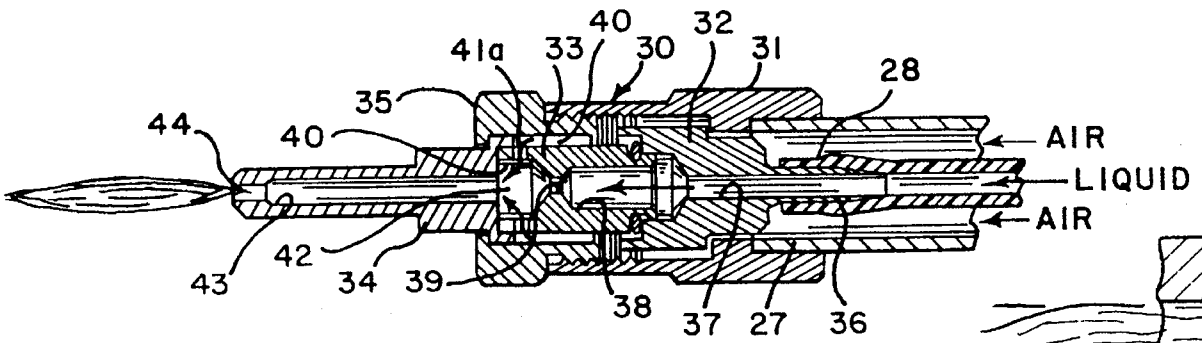
FIG. 2 is an enlarged, fragmentary, longitudinal cross-section of the tip end of the spray wand shown in FIG. 1, which shows in more detail the first preferred embodiment of the novel spray nozzle.
Figure 3:
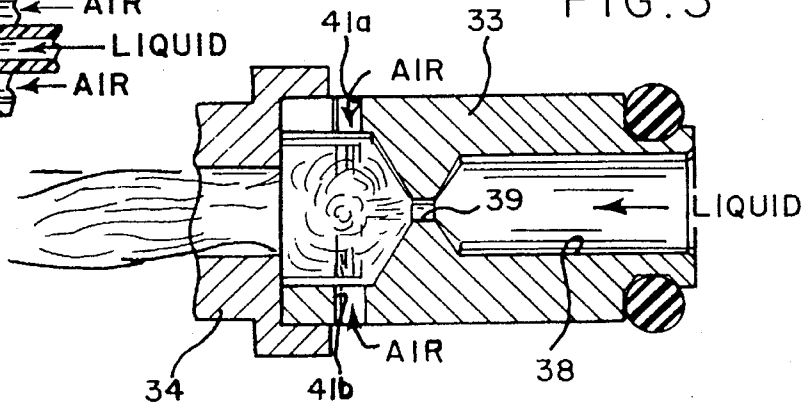
FIG. 3 is a further enlarged, partial cross-sectional view of certain components of the spray nozzle shown in FIGS. 1 and 2.

Referring now to FIGS. 1–3, there is shown an illustrative hand-held spray gun having a nozzle assembly in accordance with the present invention. This spray gun is constructed, except for incorporating the novel nozzle, substantially as described in the Evans patent discussed above. Accordingly, the text of that patent is incorporated in its entirety by this reference thereto.

The gun basically comprises three subassemblies: a handle assembly 10, a wand assembly 20, and a nozzle assembly 30. The handle assembly 10 is provided with a pressurized liquid inlet 11 adapted to connect, through a hose (not shown) with an external pressurized liquid reservoir (not shown). Liquid flows through a passageway 12 in the handle assembly 10 and is controlled by valve means 13 which is actuated by a handle 14. When the valve means 13 is open, liquid is transported through the passageway 12 in the handle assembly 10 and passes through an outlet 15 into the wand assembly 20.

The wand assembly 20 attaches to the outlet 15 of the handle assembly 10 via a lock nut 21. The wand assembly 20 comprises an outer tube 22 which has a sealed first end 23. The outer tube 22 is supplied with air via a pressurized inlet 24 which is adapted to connect, through a supply hose (not shown), with an external pressurized air source (not shown).

A capillary tube 25 is disposed within the outer tube 22. The capillary tube 25 has a first end 26 which passes through the sealed first end 23 of the outer tube 22 and communicates with the liquid outlet 15 in the handle assembly 10. The second end 27 of the outer tube 22 and the second end 28 of capillary tube 25 both communicate with the spray nozzle assembly 30, thereby permitting liquid and air to enter the spray nozzle assembly 30.

As can be seen best in FIG. 2, the spray nozzle assembly 30 comprises an internally threaded coupling 31, a connector 32, an atomizing member 33, a spray tip 34, and an externally threaded lock screw 35. The threaded coupling 31 is suitably attached to the downstream end 27 of the outer tube 22. The nozzle assembly 30 may be assembled and disassembled by screwing and unscrewing the lock screw 35, thereby securing the atomizing member 33 upstream of the spray tip 34 and providing access to the other components of the nozzle assembly 30.

The connector 32 has a nipple 36 at its upstream end which is inserted into the downstream end 28 of the capillary tube 25, thereby providing means for connecting the nozzle assembly 30 to the capillary tube 25. A passageway 37 extends through the connector 32 to its downstream end, where a plurality of shoulders and O-rings provide means for sealably engaging the upstream end of the atomizing member 33 to the connector 32.

More particularly, the atomizing member 33 is generally cylindrical with its upstream end having a generally cylindrical projection of reduced external diameter. An annular channel is provided in the upstream projection of the atomizing member 33, in which is situated an O-ring. When assembled, the O-ring is compressed between opposing shoulders in the connector 32 and the atomizing member 33.

The atomizing member 33 is provided with a passageway 38 at its upstream end which, together with the handle passageway 12, capillary tube 25, and connector passageway 37 communicate liquid to a liquid injection port 39. Further, in order to accelerate the liquid prior to its injection into a mixing chamber 42 and to assist in the atomization of the liquid, the liquid injection port 39 defines a reduced diameter passageway. That is, the passageway 38 is a generally cylindrical bore which tapers inwardly at its downstream end into communication with the liquid injection port 39. The passageway 38 has a diameter approximately 2 to 3 times the diameter of the liquid injection port 39.

An air circulation chamber 40 is defined by a generally annular space which extends between the outer surfaces of the connector 32 and the atomizing member 33 and the inner surfaces of the nozzle housing, i.e., the threaded coupling 31 and the lock screw 35. The circulation chamber 40 communicates at its upstream end with the downstream end of the outer tube 22, thereby providing means for communicating air to a pair of air injection ports 41*a* and 41*b*.

The liquid injection port 39 and the air injection ports 41*a* and 41*b* all communicate with a mixing chamber 42. As is described in more detail below, liquid is atomized in the mixing chamber 42, and atomized liquid flows from the mixing chamber 42 through a passageway 43 in the spray tip 34 and is discharged through an exit orifice 44.

The mixing chamber 42 is defined by a generally cylindrical bore in the downstream end of the atomizing member 33. The bore tapers outwardly from the downstream end of the liquid injection port 39. The mixing chamber 42 has a diameter approximately 12 to 13 times the diameter of the liquid injection port 39. The liquid injection port 39 is located in the atomizing member 33 at the upstream end of the mixing chamber 42 substantially along the longitudinal axis of the mixing chamber 42. Liquid introduced under pressure into the passageway 38 flows through the liquid injection port 39 and is injected axially as a stream into the mixing chamber 42.

The air injection ports 41*a* and 41*b* extend generally radially through the side walls of the atomizing member 33 providing radial communication between the air circulating chamber 40 and the mixing chamber 42. Preferably, the air injection ports 41 are located on diametrically opposed sides of the atomizing member 33. As a consequence, an opposing cross-flow of air is directed at the liquid stream as the liquid stream is injected into the mixing chamber 42. In other words, as can be seen best by the flow lines in FIG. 3, air is introduced under pressure into the circulation chamber 40 and flows through the air injection ports 41, thereby injecting a pair of air streams radially into the mixing chamber 42. Those air streams are substantially opposed to each other and are substantially perpendicular to the liquid stream injected into the mixing chamber.

If desired, an opposing cross-flow of air may be created by providing more than two air holes. For example, three openings could be provided spaced 120° apart, four openings could be provided spaced 90° apart, or more could be provided so long as the air streams created thereby substantially oppose each other and are substantially perpendicular to the liquid stream.

It will be appreciated that the novel nozzle assemblies, which utilize an opposing cross-flow arrangement, atomize the liquid stream more efficiently than prior art nozzles which use a parallel flow arrangement. In a parallel flow arrangement, atomization is dependent on differing velocities between the air streams and the liquid stream, a process which imparts relatively little direct force on the liquid stream. An opposing cross-flow arrangement exerts more direct shear force on the liquid stream and also creates more turbulence.

For example, a Gold Crest® Actisol® model pesticide applicator which is commercially available from Roussel Bio Corporation, Jacksonville, Fla., incorporates a spray gun which is constructed substantially as described in the previously mentioned Evans patent. The spray gun was modified so that it incorporates a novel nozzle assembly as described above. More particularly, the original mixing chamber part was replaced with an atomizing member made pursuant to the present invention as described above. The cylindrical bore of the substituted atomizing member, which substantially defines the mixing chamber, had a diameter of approximately 0.25" and a depth of approximately 0.50". The liquid injection port was an axially disposed hole measuring approximately 0.020" in diameter. The pair of radial air injection ports were holes measuring approximately 0.03125" in diameter which were located opposite each other. The wand is designed for liquid flow rates of approximately 1–2 gallons/hr. It was observed that this novel arrangement consumes air at the rate of approximately 0.5 standard cubic feet per minute. This is approximately 20–40% less than the air consumed by the commercially available model using the prior art mixing chamber part.

It will be appreciated by those skilled in the art that the optimum degree of atomization and flow rate of liquid depends on the particular application and system in which the nozzle will be used. Liquid atomization and flow rate are dependent on a variety of well known factors, including the viscosity of the liquid, the cross section of the air and liquid injection ports, the volume of space in the mixing chamber, and the configuration of the exit orifice in the spray tip. These factors may be varied by those of ordinary skill in the art to produce a desired degree of atomization and flow rate. All other factors being equal, however, it is believed that an opposing cross-flow of air provides relatively higher air efficiency, thereby decreasing air consumption.

It also will be appreciated that the atomizing member can be manufactured more easily and reliably. Fewer drillings are necessary to form the bore and injection ports in the atomizing member. Moreover, there are fewer drillings which require close tolerances and alignment of the air injection port is more easily accomplished. This design is relatively simple and has a minimum of parts, which can increase the economy of its manufacture and also lends itself to casting methods wherein more wear resistant materials, such as ceramics, may be used. It also should be appreciated that, being generally cylindrically shaped and lacking the perforated, annular disk-shaped structure which is part of the prior art, the atomizing member of the nozzle of the present invention is much more durable and less susceptible to bending or breaking.

Figure 4:
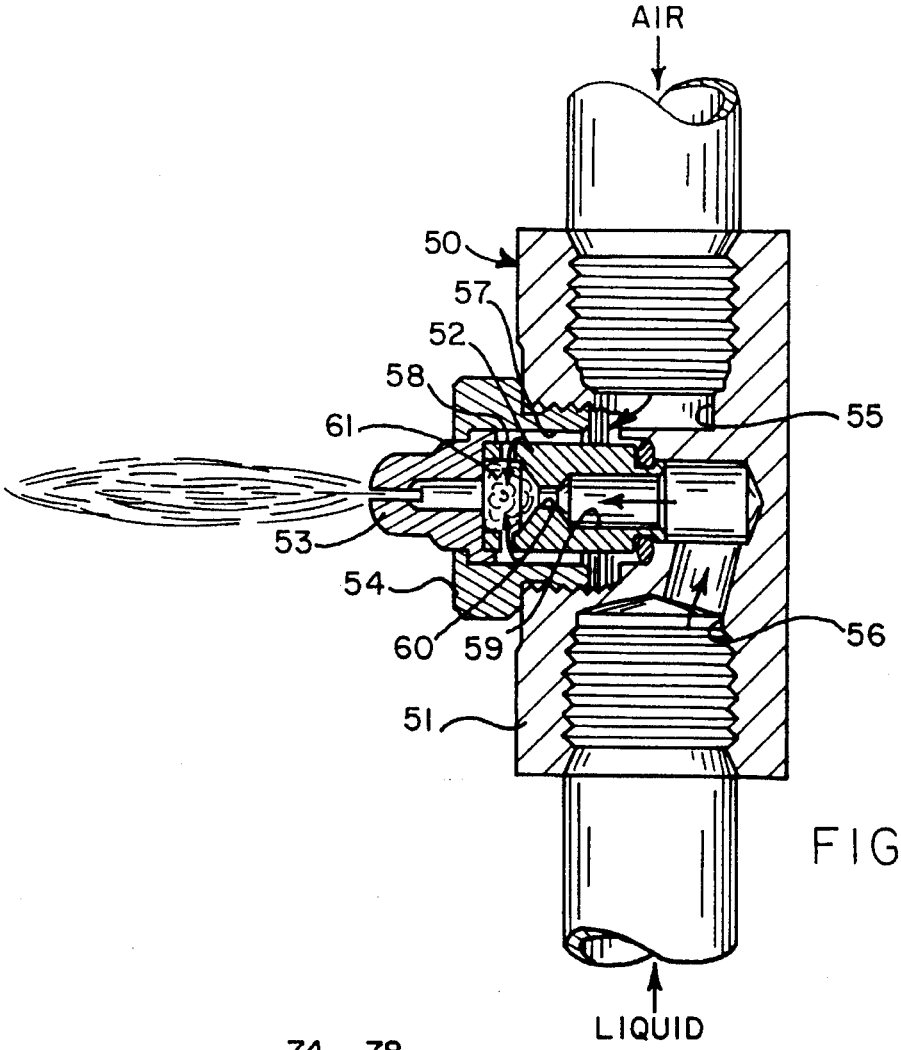
FIG. 4 is a side view, partially in section, of a second preferred embodiment of the novel air assisted atomizing spray nozzle.

A second preferred embodiment of the subject invention is shown in FIG. 4. This embodiment is an air assisted atomizing spray nozzle which is part of a more or less permanently installed system, such as may be used to humidify rooms in which paper is processed. The nozzle 50 comprises a body portion 51, a generally cylindrically shaped atomizing member 52, a spray tip 53, and a locking screw 54. The nozzle body 51 has a pressurized air inlet 55 and a pressurized liquid inlet 56.

In carrying out the invention, the atomizing member 52 of the second embodiment has a design identical to that of the atomizing member 33 discussed above in reference to the first embodiment, and otherwise the functioning of the nozzle 50 is substantially identical to that of the nozzle assembly 30. Air flows through a circulating chamber 57, which is defined by a generally annular space which extends between the outer surface of the atomizing member 52 and the inner surface of the locking screw 54, and then is injected through radial air injection ports 58 into a mixing chamber 61. Liquid is introduced through the pressurized liquid inlet 56, and ultimately flows through a passageway 59, which is generally cylindrical and tapers inwardly at its downstream end to a liquid injection port 60, thereby providing a reduced diameter passageway through which liquid is accelerated prior to injection into the mixing chamber 61. The diameter of the passageway 59 is approximately 2 to 3 times the diameter of the injection port 60.

The mixing chamber 61 is defined by a generally cylindrical bore in the downstream end of the atomizing member 52. The bore tapers outwardly from the downstream end of the liquid injection port 60. The diameter of the mixing chamber 61 is approximately 8 to 10 times the diameter of the liquid injection port 60. A liquid stream is injected axially into the mixing chamber 61 through the liquid injection port 60, where the stream is subjected to opposing cross air flows to finely atomize the liquid.

Figure 5:
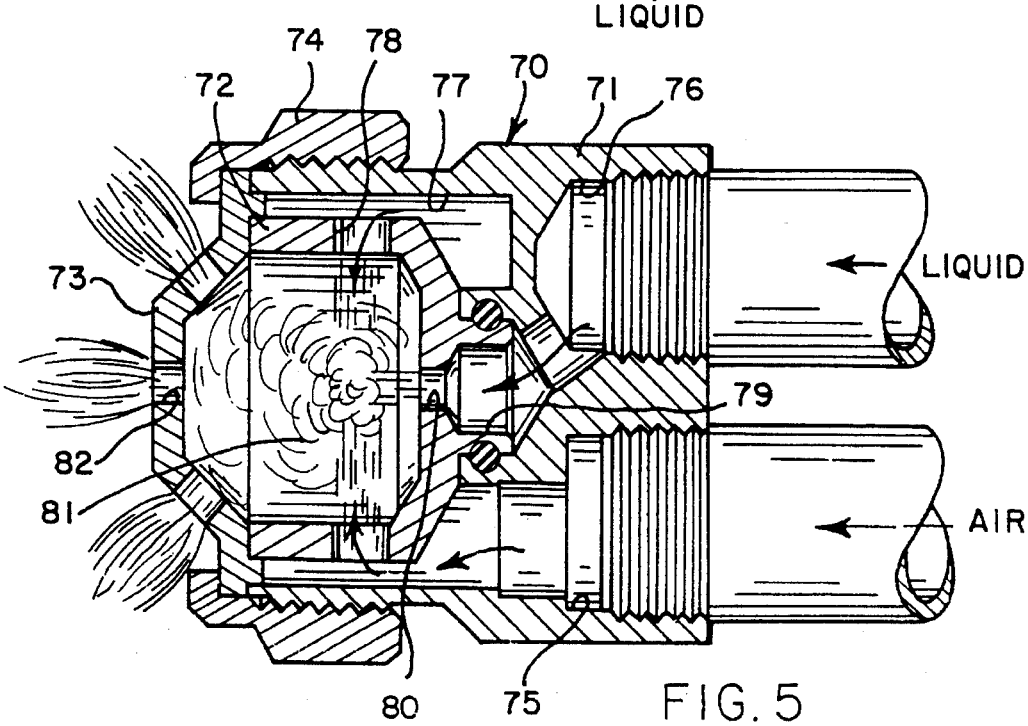
FIG. 5 is a side view, partially in section, of a third preferred embodiment of the novel air assisted atomizing spray nozzle.
Figure 6:
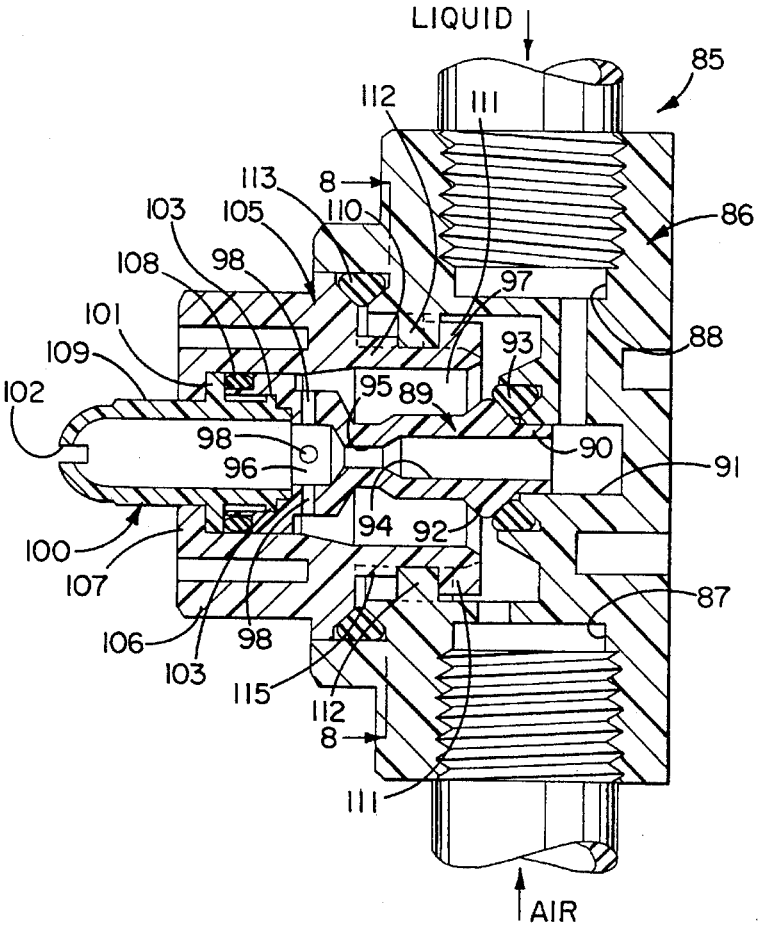
FIG. 6 is a view generally similar to FIG. 4 but shows still another preferred embodiment of the novel air assisted atomizing spray nozzle.
Figure 7:
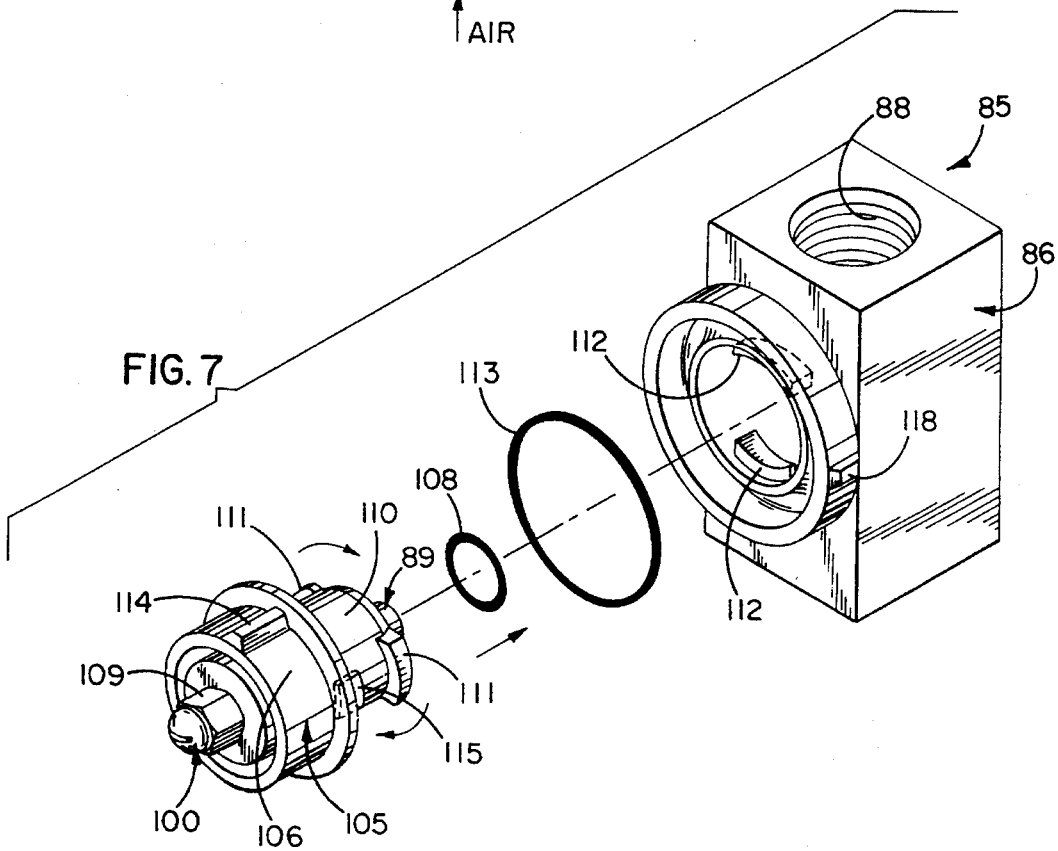
FIG. 7 is an exploded perspective view of the nozzle shown in FIG. 6.
Figure 8:
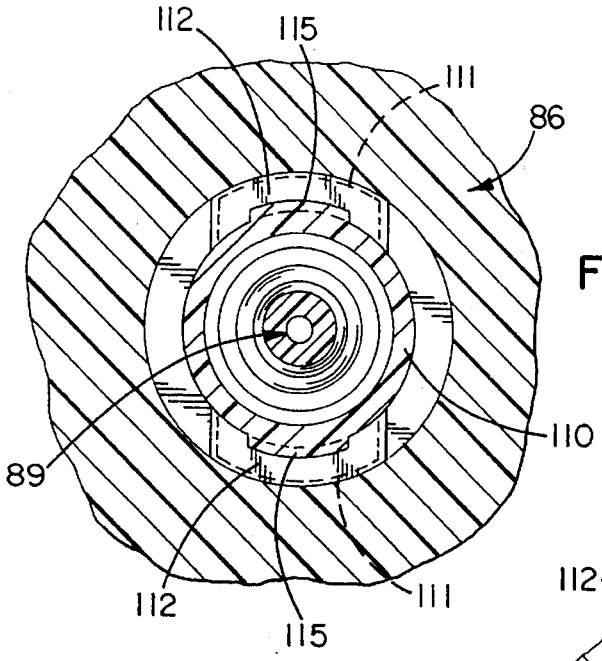
FIG. 8 is a fragmentary cross-section taken substantially along the line 8—8 of FIG. 6.
Figure 9:
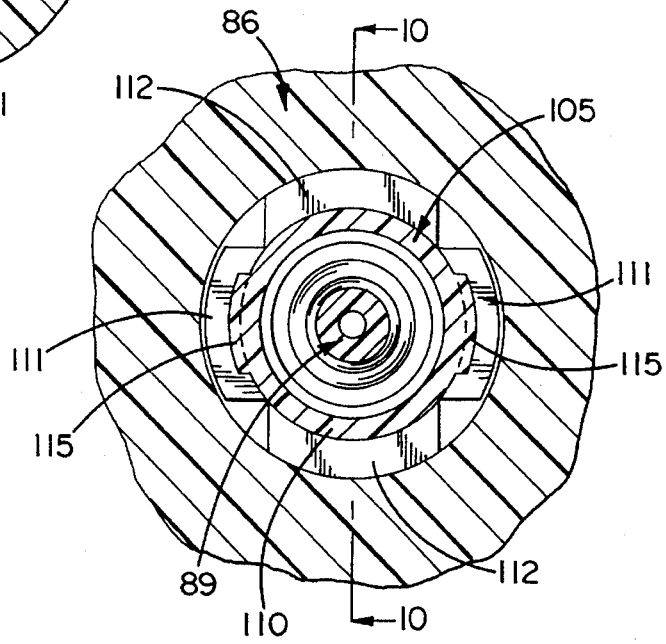
FIG. 9 is a view similar to FIG. 8 but shows certain components in moved positions.
Figure 10:
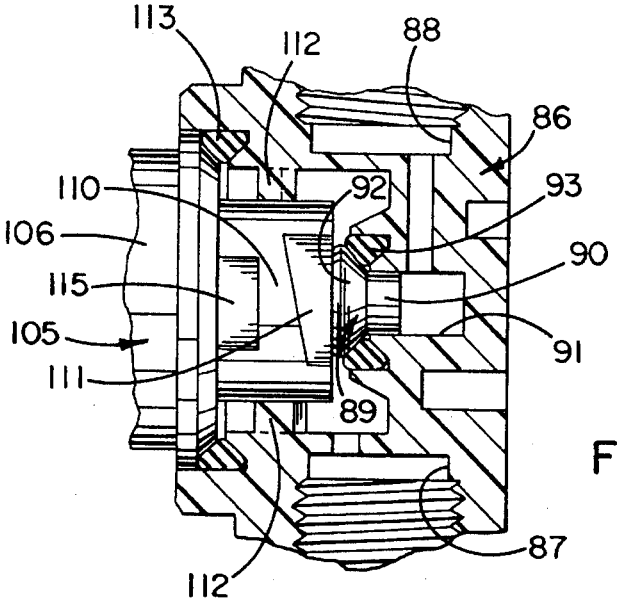
FIG. 10 is a fragmentary cross-section taken substantially along the line 10—10 of FIG. 9.

A third preferred embodiment of the subject invention is shown in FIG. 5. This air assisted atomizing nozzle is especially suitable for spraying relatively large quantities of liquid, such as limestone slurry used in smoke stack scrubbing. The nozzle assembly 70 has a body portion 71, a generally cylindrically shaped atomizing member 72, a spray tip 73, and a locking nut 74. The nozzle body 71 has an air inlet 75 and a liquid inlet 76 coupled to respective supply lines.

The nozzle assembly 70 of this embodiment has substantially the same design as that shown in the previous embodiments, but it may be proportionately larger so that the spraying capacity of the nozzle may be increased. Air is introduced through the inlet 75, flows through a circulating chamber 77 which is defined by a generally annular space which extends between the outer surface of the atomizing member 72 and inner surfaces of a generally cylindrical bore in the body portion 71, and is injected through radial air injection ports 78 into a mixing chamber 81. Liquid is introduced through the inlet 76, and ultimately flows through a passageway 79, which is generally cylindrical and tapers inwardly at its downstream end to a liquid injection port 80, thereby providing a reduced diameter passageway through which liquid is accelerated prior to its injection into the mixing chamber 81. The diameter of the passageway 79 is approximately 2 to 3 times larger than that of the liquid injection port 80.

The mixing chamber 81 is defined by a generally cylindrical bore in the downstream end of the atomizing member 72. The bore tapers outwardly from the downstream end of the liquid injection port 80. The diameter of the mixing chamber 81 is approximately 6 to 7 times the diameter of the liquid injection port 80. A liquid stream is injected axially into the mixing chamber 81 through the liquid injection port 80. As with the other embodiments, the liquid stream is subjected to opposing cross-flow air streams in the mixing chamber 81. In order to vary the shape of the spray pattern, the spray tip 73 may have one or more exit orifices. For example, the spray tip 73 in this embodiment has a plurality of round orifices 82 to generate a wide angle round spray. It also may be provided with a single round orifice to produce a narrow angle round spray, or it may have one or more elliptical orifices to generate a flat spray pattern.

Another preferred embodiment of a nozzle 85 is shown in FIGS. 6–10, is generally similar to the nozzle 50 of FIG. 4 and is characterized by its low cost construction and by the ability of its atomizing member and spray tip to be easily removed for repair or replacement purposes. Specifically, the nozzle 85 comprises a body or housing 86 preferably injection molded of plastic and having a pressurized air inlet 87 and a pressurized liquid inlet 88. A plastic atomizing member 89 is formed with an upstream end portion 90 which is telescoped in a bore 91 in the housing in communication with the liquid inlet, there being an enlarged seat or collar 92 formed around the atomizing member for seating and sealing against an O-ring 93 in the housing. Liquid from the inlet 88 flows axially through a generally cylindrical passageway 94 in the atomizing member and then is accelerated by a reduced diameter liquid injection port 95 prior to being discharged into a mixing chamber 96. As is the case with the embodiment of FIG. 4, the diameter of the passageway 94 is approximately 2 to 3 times the diameter of the injection port 95.

The mixing chamber 96 is defined by a generally cylindrical bore in the downstream end portion of the atomizing member 89, the bore tapering outwardly from the downstream end of the injection port 95. The diameter of the mixing chamber is 3 to 4 times that of the injection port.

Pressurized air from the air inlet 87 flows through a circulating chamber 97 and then passes into the mixing chamber 96 through four angularly spaced and radially extending air injection ports 98. The liquid stream is subjected to opposing cross air flows in order to finely atomize the liquid.

The atomized liquid is discharged to atmosphere through a spray tip 100 which also is preferably molded of plastic. Herein, the upstream end portion of the spray tip is telescoped into the downstream end portion of the atomizing member 89 and includes a radially outwardly extending flange 101 which seats against the extreme downstream end of the atomizing member. For locking the spray tip 100 to the atomizing member 89 and for preventing relative rotational movement therebetween, the spray tip 100 is formed with a pair of outwardly extending, diametrically opposed keys or lugs 103, which are received in respective keyways in the atomizing member 89. Liquid is sprayed from the tip by way of a discharge orifice 102, which in this case is in the form of an elongated slit for producing a flat spray discharge.

In carrying out the invention, the nozzle 85 is provided with a cap 105, preferably molded of plastic, which locks the atomizing member 89 and the spray tip 100 in assembled relation with the housing 86 while allowing quick and easy removal of the atomizing member and the tip for purposes of cleaning, repairing or replacing those components. The cap includes an exposed portion 106 located outside of the housing 86 and formed with a radially inwardly extending flange 107 adapted to abut the downstream face of the flange 101 of the tip. The cap is hollow in order to receive the atomizing member 89 and the tip 100 and co-acts with the flange 101 and the outer periphery of the downstream end portion of the atomizing member to define a groove for receiving an O-ring 108 which establishes an air-tight seal between the atomizing member and the cap. For facilitating predetermined orientation of the spray tip 100 discharge orifice 102 with respect to the cap 105 and for preventing relative rotational movement between the adaptor 89 and spray tip 100 and the cap 102, the spray tip 100 has a hex shaped outer end portion 109 which is received within a central hex shaped aperture of the cap 105. It will be appreciated that the flats defined by the hex shape of the outer end portion 109 of the spray tip 100 and the cap aperture allow the elongated discharge orifice 102 of the spray tip to be indexed at 45 degree intervals with respect to the cap by selective mounting of the spray tip in the hex opening of the cap.

The cap 105 further includes a reduced diameter portion 110 disposed in the housing 86 and located in radially outwardly spaced relation with the atomizing member 89 so as to coact with the latter to define the air circulating chamber 97. Pursuant to a further feature of the invention, the housing 86 and the reduced diameter portion 110 of the cap 105 are formed with co-acting means which enable the reduced diameter portion to be inserted linearly into the housing without rotating the cap relative to the housing and, after such insertion, to enable the cap to be locked to the housing by rotating the cap through substantially less than one full turn with respect to the housing. In this instance, these means comprise two diametrically spaced and radially outwardly extending ears 111 formed integrally with the reduced diameter portion 110 of the cap 105. In addition, such means comprise a generally similar pair of diametrically spaced and radially inwardly extending ears 112 molded integrally with the housing 86. The ears 112 are spaced angularly from one another by a sufficient distance to enable the ear 111 to pass between and beyond the ears 112 when the reduced diameter portion 110 of the cap 105 is inserted linearly into the housing 86.

With the foregoing arrangement, it will be seen that with the atomizing member 89 and spray tip 100 subassembly locked together they may be assembled in the cap 105 with the discharge orifice 102 of the tip appropriately orientated. For assembling the cap, tip and atomizing member in the housing, the cap is orientated such that the ears, 111 are aligned angularly with the spaces between the ears 112 (see FIGS. 9 and 10). Accordingly, the ears 111 pass between and beyond the ears 112 during insertion of the reduced diameter portion into the housing. As soon as the ears 111 have passed beyond the ears 112, the cap is rotated clockwise (FIG. 7) through approximately one-quarter of a turn by manually gripping and turning the exposed portion 106 of the cap. As a result of such rotation, the ears 111 move into face-to-face relation with the ears 112 (see FIG. 8). Opposing faces of the ears 111 and 112 are formed with appropriately shaped cam surfaces which, during clockwise rotation of the cap, force the cap axially in a direction moving the reduced diameter portion 110 further into the housing 86. As a result, the cap compresses the O-ring 113 and, at the same time, the flange 107 acts against the flange 101 to force the spray tip 100 axially against the atomizing member 89. The axial force is transmitted through the atomizing member to cause the collar 92 thereof to compress the O-ring 93. Accordingly, the atomizing member, the spray tip and the cap are all securely locked to the housing 86 simply by turning the cap through approximately one-quarter of a turn. Lugs 115 on the cap portion 110 in axially spaced relation with the ears 111 engage the ears 112 to limit axial movement of the cap portion into the housing 86.

Pursuant to a further feature of the invention, to facilitate orientation of the elongated discharge orifice 102 of the spray tip 100 for the desired direction of the flat spray discharge, the exposed portion 106 of the cap and the housing 86 are formed with respective identifying lugs 114, 118. It will be understood by one skilled in the art that the spray tip 100 may be positioned within the hex opening of the cap 105 during assembly depending upon the desired orientation of the discharging flat spray pattern, such that when the cap 105 is in its fully engaged operative position, the lugs 114, 118 will be in alignment. When the cap 105 is removed and replaced, the side-by-side orientation of the identifying lugs 114, 118, provides automatic assurance that the spray tip 100 is properly orientated.

The compressed O-rings 93 and 113 urge the cam faces of the ears 111 and 112 into frictional engagement and resist turning of the cap 105 in a counterclockwise direction. By forcibly rotating the cap in that direction, however, the ears 111 may be aligned with the spaces between the ears 112 and the cap then may be pulled away from the housing 86. Thus, the atomizing member 89 and the spray tip 100 may be cleaned or, if desired, replaced with a different type of atomizing member and/or spray tip.

I claim:

1. An air assisted atomizing nozzle assembly comprising a housing having a pressurized liquid inlet and a pressured air inlet, an atomizing member defining (i) a mixing chamber having a longitudinal axis, (ii) a liquid injection port in axial communication with said mixing chamber for injecting a liquid stream axially into said mixing chamber, and (iii) a plurality of air injection ports in radial communication with said mixing chamber for injecting a plurality of air streams radially into said mixing chamber thereby to atomize said liquid stream, a spray tip located downstream of said mixing chamber for spraying the atomized liquid into the atmosphere, and means for holding said spray tip and said atomizing member in assembled relation with said housing with said spray tip in communication with said mixing chamber and with said liquid injection port and said air injection ports in communication with said air inlet and said liquid inlet, respectively, said means comprising a cap engageable with at least one of said spray tip and said atomizing member, and co-acting means on said cap and said housing permitting a portion of said cap to be inserted linearly into said housing without turning said cap relative to said housing, said co-acting means being operable after insertion of said cap portion into said housing and after said cap has been rotated through less than one full turn relative to said housing to lock said cap to said housing and to cause said cap to hold said spray tip and said atomizing member in fixed relation with said housing.

2. A nozzle assembly as defined in claim 1 in which said housing includes a seat for said atomizing member, said co-acting means causing said atomizing member to be forced axially against said seat after said cap portion has been inserted linearly into said housing and after said cap has been rotated relative to said housing through less than one full turn to lock said cap to said housing.

3. A nozzle assembly as defined in claim 2 in which said spray tip and said atomizing member are separately formed components which are telescoped with one another and have co-acting seats, and means on said cap for forcing said co-acting seats into axial engagement after said cap portion has been inserted linearly into said housing and after said cap has been rotated relative to said housing through less than one full turn to lock said cap to said housing.

4. A nozzle assembly as defined in claim 1 in which said co-acting means comprise a first plurality of angularly spaced ears on said cap portion and further comprise a second plurality of angularly spaced ears in said housing, said ears on said cap portion passing between said ears in said housing during linear insertion of said cap portion into said housing and interlocking with the ears in said housing when said cap is rotated relative to said housing in one direction and through less than one full turn.

5. A nozzle assembly as defined in claim 4 in which said co-acting ears are formed with co-acting cam surfaces which draw said cap portion further into said housing when said cap is rotated relative to said housing in said one direction and through less than one full turn.

6. A nozzle assembly as defined in claim 1 in which said spray tip is formed with an elongated discharge orifice for producing a flat spray discharge, said spray tip having an outer end portion forward with locating flats, and said cap being formed with a central opening with flats for receiving said spray tip in predetermined angular relation and for preventing relative rotation therebetween.

7. A nozzle assembly as defined in claim 6 in which said spray tip has a hex configured outer end portion and said cap opening is hex-shaped.

8. A nozzle assembly as defined in claim 1 in which said cap and housing each are formed with identifying lugs which are positionable into side-by-side relation when said tip is in a fully and properly mounted position.

9. An air assisted atomizing nozzle assembly comprising a housing having a pressurized liquid inlet and a pressurized air inlet, an atomizing member defining (i) a mixing chamber having a longitudinal axis, (ii) a liquid injection port in axial communication with said mixing chamber for injecting a liquid stream axially into said mixing chamber, and (iii) a plurality of air injection ports in radial communication with said mixing chamber for injecting a plurality of air streams radially into said mixing chamber thereby to atomize said liquid stream, a spray tip telescoped with said atomizing member and located downstream of said mixing chamber for spraying atomized liquid into the atmosphere, a cap having a first portion insertable into said housing and having a second portion engageable with said spray tip, co-acting means on said first cap portion and said housing and permitting said first cap portion to be inserted linearly into said housing without turning said cap relative to said housing, said co-acting means being operable after said first cap portion has been inserted into said housing and after said cap has been rotated through less than one full turn relative to said housing to lock said cap to said housing and to cause said cap to press said spray tip into axial engagement with said atomizing member and to press said atomizing member into axial engagement with said housing.

* * * * *